United States Patent [19]

Grancoin

[11] 4,150,653

[45] Apr. 24, 1979

[54] SYSTEM EMPLOYING A MAGNETOSENSITIVE ELEMENT FOR PRODUCING AN ELECTRIC SIGNAL IN SYNCHRONISM WITH THE PERIODIC MOVEMENT OF A PART AND APPLICATION THEREOF IN INTERNAL COMBUSTION ENGINES

[75] Inventor: Bernard Grancoin, Paris, France

[73] Assignee: Thomson-CSF, Paris, France

[21] Appl. No.: 764,546

[22] Filed: Feb. 1, 1977

[30] Foreign Application Priority Data

Feb. 4, 1976 [FR] France ..... 76 03111

[51] Int. Cl.[2] ..... F02P 1/00; F02P 5/04

[52] U.S. Cl. ..... 123/148 E; 324/200; 324/169

[58] Field of Search ..... 123/148 E, 148 CB, 117 R, 123/146.5 A; 324/34 PS, 169, 179

[56] References Cited

U.S. PATENT DOCUMENTS

| | | | |
|---|---|---|---|
| 3,675,636 | 7/1972 | Hini | 123/148 E |
| 3,875,920 | 4/1975 | Williams | 123/148 E |
| 4,011,476 | 3/1977 | Beard | 123/148 E |

FOREIGN PATENT DOCUMENTS

| | | | |
|---|---|---|---|
| 958971 | 2/1957 | Fed. Rep. of Germany | 123/148 E |

*Primary Examiner*—Ronald B. Cox

*Attorney, Agent, or Firm*—Cushman, Darby & Cushman

[57] ABSTRACT

A phase-controlled pulse signal generator, comprising a magnetic field source born by a rotating shaft, and a Hall effect sensor submitted to the field, the sinusoidal signal delivered being processed by a phase correcting circuit controlled by the speed of the shaft, followed by a triggered pulse circuit.

17 Claims, 25 Drawing Figures

SYSTEM EMPLOYING A MAGNETOSENSITIVE ELEMENT FOR PRODUCING AN ELECTRIC SIGNAL IN SYNCHRONISM WITH THE PERIODIC MOVEMENT OF A PART AND APPLICATION THEREOF IN INTERNAL COMBUSTION ENGINES

The invention relates to a system employing a magnetosensitive element for producing an electric signal in synchronism with the periodic movement of a part and the application thereof in internal combustion engines. It in particular relates to a system employing a Hall generator as the magnetosensitive element.

In machines having a cyclic operation, as in particular in internal combustion engines, certain operations or certain movements must be controlled or actuated in synchronism with the displacement or rotation of a part, as for example the ignition, the injection, a displacement of a valve etc... This synchronism is usually provided with corrections which are a function of the speed or other parameters, such as for example the power or the torque. Presently-known systems are of two types. The systems of the first type employ mechanical arrangements (cams, eccentrics etc...) and become worn and out of order, not to mention the complication of their manufacture and the difficulties experienced in introducing correctiong parametes. The systems of the second type employ opto-electronic sensors or proximity sensors having a variable inductance: the sensor employing variable reluctance or induction are difficult to employ owing to the sensitivity of the magnitude of the signal that they produce to the speed of displacement of the moving part. Moreover, the signals thus produced must be processed in a computer in order to effect the desired corrections as a function of the various parameters. They are indeed in the form of pulses or at least have an intensity which is highly variable as a function of the speed, and their processing implies the use of a complex and costly electronic unit.

In order to overcome these drawbacks, there is employed as a position sensor a detector sensitive to the intensity of the magnetic field and not to the speed of its variation, whereas the moving part produces by its movement a substantially sinusoidal variation in the magnetic field.

In the invention, a magnetic source secured to the moving part moves in the vicinity of a magnetosensitive element, the form of the magnetic source and its movement producing on the magnetosensitive element a substantially sinusoidal variation of the magnetic field, said element producing a substantially sinusoidal signal which is in phase with the periodic movement and independent of the speed.

The fact that the signal obtained is sinusoidal and indepenent of the speed, permits subjecting in a simple manner to a phase shift as a function of the speed or any other parameter in accordance with a law which may be chosen.

According to another feature of the invention, the sinusoidal signal produced by the sensitive element is subject to a phase shift by means of a phase correcting circuit, or phase shifting circuit, while conserving its sinusoidal signal character.

The control or actuation of a part must be effected by a pulse having at least one steep edge at a precise instant.

According to a further feature of the invention, the phase shifted sinusoidal signal is applied to a shaping and power circuit delivering a steep edge pulse at the moment when the sinusoidal input signal passes through a predetermined value.

For reasons of precision of the instant of the production of this steep edge pulse, the pulse is produced at a moment when the voltage of the sinusoidal signal varies at the highest rate, that is to say in the neighborhood of zero potential.

The circuit for correcting the phase as a function of the speed is constituted by an inductive loop which is exposed to the variation of the magnetic field and delivers a sinusoidal signal whose amplitude is a function of the speed. In adding the signals from the magnetosensitive element and the inductive loop, there is obtained a signal which is still sinusoidal but shifted in phase to be advanced with respect to time.

Another arrangement for effecting this phase shift consists in employing a circuit comprising a combination of passive elements such as resistors and capacitors.

The magnetosensitive element employed is usually a Hall generator, but it may also be a magnetoresistant element. The latter are usually employed in pairs which are connected in a bridge network with two resistors.

It happens that the features of such a system are particularly well adapted to the cyclic control of parts of internal combustion engines and in particular the ignition or the injection, the phase differences of which must be variable as a function of a plurality of parameters such as the speed, the power, the torque etc...

According to one application of the invention, a combustion engine is adapted to this system and comprises, firstly, on a shaft connected to the crankshaft, a moving part which is magnetized in permanent manner, said moving part rotating in the vicinity of another or stator part of soft magnetic alloy, and, secondly, a magnetosensitive element secured to the stator part and located between said stator part and the moving part.

Further features and advantages of the invention will be apparent from the ensuing description of particular embodiments given with reference to the accompanying drawings in which:

FIG. 16 shows the diagram of another system for an engine having four cylinders;

Figure 1:
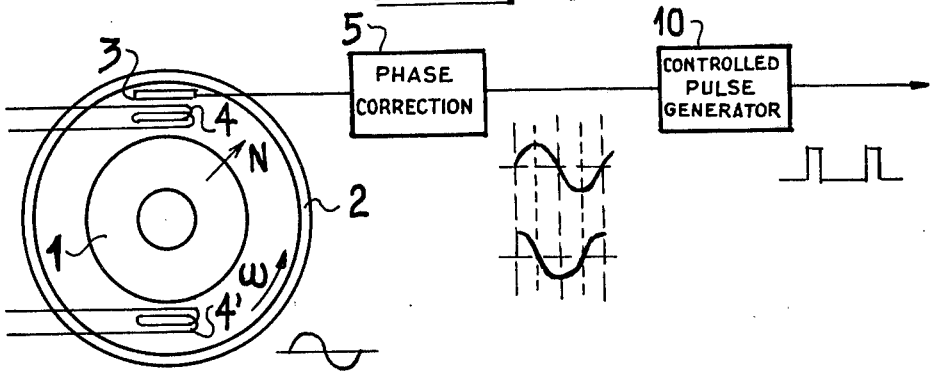
FIG. 1 is a diagram of the position sensor according to the invention.

There is shown diagrammatically and in section in FIG. 1 a moving part which undergoes a periodic movement and is represented by a disc 1 which is magnetized in the direction of the arrow and rotates in the direction indicated at the speed $\omega$. A stator part 2 in the form of a torus of soft magnetic material surrounds the magnetic disc 1. A magnetosensitive element 3 is fixed between the disc 1 and the stator part 2.

According to one feature of the invention, the form of the magnetization of the part represented by the disc 1 is such that when this part rotates, the magnetic field applied to the element 3 varies in a substantially sinusoidal manner as a function of the angle made by the direction of the magnetization with the element 3. Consequently, there is received at the terminals of this element a substantially sinusoidal voltage shown in FIG. 2 in which the voltages U are plotted as ordinates and the angles $\omega t$ that the disc makes with an origin position are plotted as abscissae.

The fact that this voltage has a sinusoidal form (and is not a simple pulse) permits an application thereto of a phase shifting correction by means of a simple electronic circuit carrying the reference numeral 5 in FIG. 1, which phase shift can be a function of various parameters and in particular the speed $\omega$.

In the latter case, the circuit 5 may be constituted by a flat stator coil 4 constituted by one more wound wires placed in the airgap either in the region of the magnetosensitive element, or at 180 electric degrees thereto (reference numeral 4').

This phase shifting loop operates in the following manner: let be $V_H$ be the voltage received at the terminals of the element 3 and $V_B$ that received at the terminals of the loop 4, there is obtained:

$$V_H = K_1 \cos \omega t$$

$$V_B = K_2 \omega \sin \omega t$$

these two voltages are added, the resulting voltage U will also be a sinusoidal wave which is shifted in phase with respect to the voltage $V_H$ by an amount which increases with the speed $\omega$. The value of this phase shift d is given by the formula:

$$d = \arctan (K2/K1)$$

Figure 2:
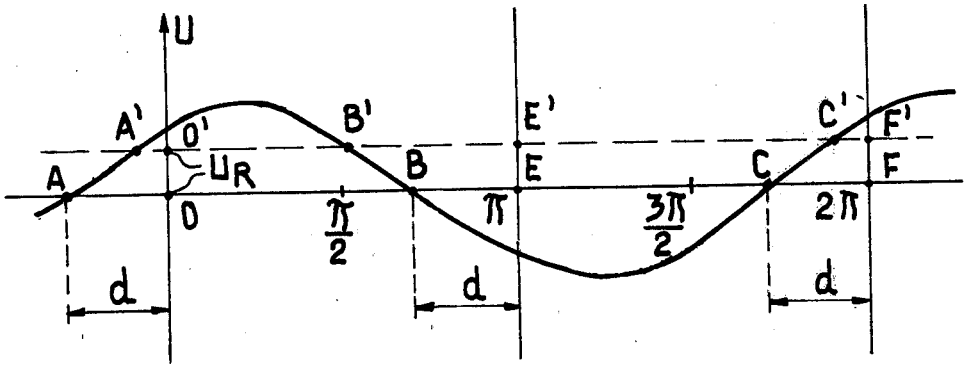
FIG. 2 shows the shape of the signal produced by a magnetosensitive element.

It appears in FIG. 2 at AO, BE, CF.

This loop 4 may be constituted, as mentioned hereinbefore, by one or more turns wound flat by defining a given surface to obtain the desired law for the variation of the phase shift. But it is possible to construct this coil in a manner which results in a greater simplicity of assembly.

Figure 5:
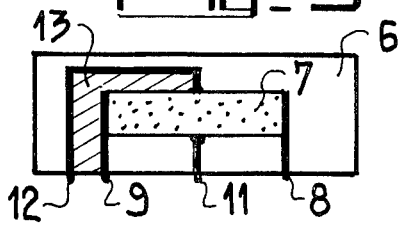
FIG. 5 is a view of a Hall generator with its correcting loop incorporated therein.

According to another feature of the invention, the coil is constituted by the connection of the sensitive element which defines a loop of well-determined surface, and is constituted by the deposit of a conductor on the very substrate which supports the magnetosensitive element. FIG. 5 illustrates this device which is applied to the case where the magnetosensitive element is a Hall generator, but which is also applicable to any magnetosensitive element deposited on a substrate.

FIG. 5 shows the substrate 6, for example of alumina or magnetic ferrite, on which there has been deposited a semiconductor layer constituting the Hall generator 7 with its supply electrodes 8 and 9 and the output electrodes 11 and 12. It will be observed that the output electrode 12 defines a surface 13 (cross-hatched in FIG. 5) the size of which has been chosen to give the coefficient of induction corresponding to the characteristics of the desired correction of phase as a function of the speed.

It will be clear that this simultaneous construction in one piece of the Hall generator with its correcting loop on the same substrate, above all when it is obtained by the techniques of evaporation, results in great simplicity of manufacture and utilization and high reliability.

The object of the invention is to determine the instant of the cyclic operation of a part. There will be chosen for this the instant when the voltage U varies the most rapidly as a function of the angle $\omega t$, that is to say, in the neighborhood of the passages through zero.

The utilization of the passage through zero of the voltage U for determining the instant of a control or actuation requires that there be no residual voltage at the terminals of the magnetosensitive element, that is to say no voltage appearing in the absence of a magnetic field.

In FIG. 2 there has been marked a dotted abscissa line having an origin 0' corresponding to a negative residual voltage $U_R$. It can be seen that in this case the passages through zero of the resulting voltage namely A', B', C' are not equally spaced apart and, in particular, that the phase shift A', O', B'E', C'F' is different according to whether it concerns a passage through zero from negative to positive or a passage from positive to negative.

As will be mentioned hereinafter, every other passage through zero will be employed, or there will have to be employed a magnetosensitive element which is particularly well compensated and consequently more expensive. The presence of a residual voltage introduces a phase shift, but in the case of the utilisation of every other passage through zero, this phase shift may be compensated for by an angular offset of the stator part which results in the same compensation for all the passage through zero employed. This arrangement is not completely in the case where an inductive loop is employed for the phase shift, but the residual voltages are small with respect to the voltages delivered by the magnetosensitive elements and the result remains within the required tolerances for practical utilization.

The sinusoidal shape of the signals produced by the magnetosensitive element, and their sum with the signals produced by an inductive loop, permits a processing thereof, and in particular a phase shifting thereof by ordinary electronic circuits comprising no active element. Thus the correcting circuit 5 may be constituted by a combination of resistors and capacitor. The signal from the element 3 may be applied to the correcting circuit 5 either directly or through a loop 4.

Figure 3:
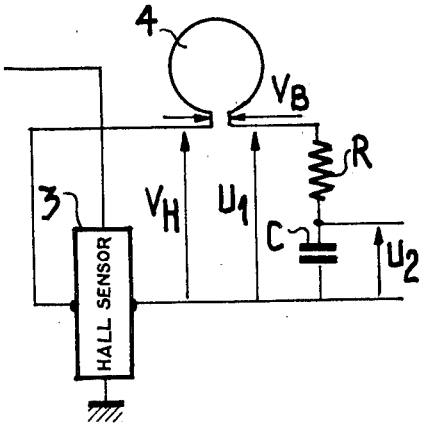
FIG. 3 is a diagram of a circuit for processing the signal.
Figure 4:
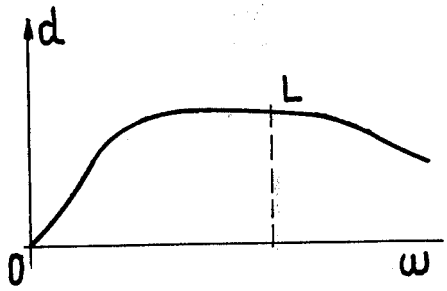
FIG. 4 shows a curve pertaining to the correction of the phase as a function of the speed.

FIG. 3 shows the diagram of such a circuit 5 in which the voltage:

$$V_1 = V_H + V_B$$

is applied to a resistor R connected in series with a capacitor C at the terminals of which a voltage $U_2$ appears. This voltage undergoes with respect to $V_H$ a double phase shift, first by the loop 4 and thereafter by the RC circuit. Depending on the characteristic values of the components, it is thus possible to adapt the phase shift value d variable with the speed $\omega$ according to a desired law. One example is given in FIG. 4 in which the speeds are plotted as abscissae and the phase shifts as ordinates. The zone of utilization of the system is usually limited to the portion of the curve OL in which the derivative does not change sign. The value of the phase shift commences by increasing rapidly with the speed, then increases less rapidly and becomes roughly constant.

The possibility of treating the sinusoidal signal produced by the magnetosensitive element permits multiple conbinations for obtaining the desired laws of variation of advance of phase as a function of the speed.

Figure 6:
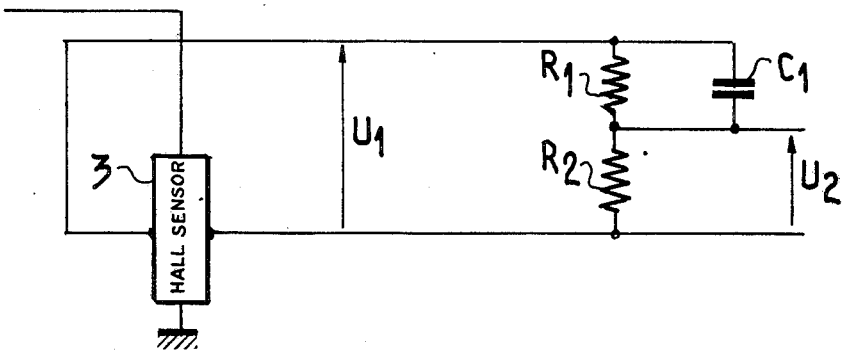
FIG. 6 shows a phase correcting circuit which does not have an inductive loop.

FIG. 6 shows a system according to the invention in which the phase advance correcting circuit 5 is an RC circuit with no inductive loop. The connections of the magnetosensitive element 3 giving the voltage $U_1$ are connected to two resistors in series $R_1$ $r_2$, a capacitor $C_1$ being connected in parallel with the resistor $R_1$. The useful voltage $U_2$ is received at the ends of the resistor $R_2$. It can be seen that this device shifts forward or advances the sinusoidal voltage $U_1$, as the inductive loop of the preceding embodiment.

Thus with:

a monocrystalline germanium Hall generator excited by a current of 20 mA a resistor $R_1$ of 10,000 ohms a resistor $R_2$ of 5,000 ohms a capacitor $C_1$ of 0.75 microfarad there was achieved a phase advance of 10 to 15 degrees for a frequency of the signal $U_1$ varying from 500 to 3,000 periods per minute.

Figure 7:
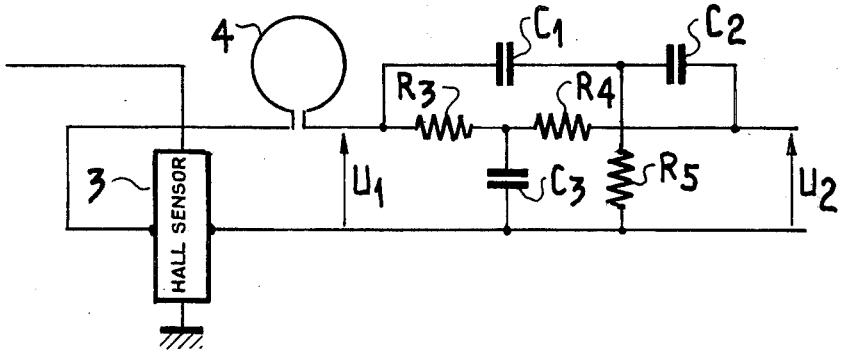
FIG. 7 shows another phase correcting circuit.
Figure 8:
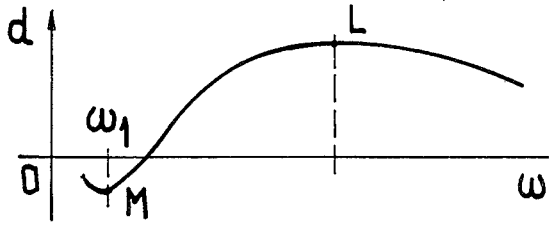
FIG. 8 shows the phase correcting curve of the preceding circuit.

FIGS. 7 and 8 give another embodiment of the phase shifting correcting circuit. In FIG. 7, the sinusoidal voltage $U_1$ furnished by the magnetosensitive element is applied to a circuit of three resistors $R_3$, $R_4$ and $R_5$ associated with three capacitors $C_1$, $C_2$ and $C_3$ to give an output voltage $U_2$. This circuit, shown in FIG. 7, is a combination of devices some of which give a retard correction and the others an advance correction as a function of the speed with different ratio. The result thereof is a law of correction of the phase shift as a function of the speed given in FIG. 8. The region of utilization stops at the point marked L on the curve. It can be seen that the latter has, in contradistinction to that shown in FIG. 4, a minimum at M. This result may be employed in an interesting manner, for example as will be explained hereinafter, for controlling the ignition of explosion engines. If it is arranged that the speed $\omega 1$, corresponding to the minimum phase shift, be that of idling speed, any variation in speed will increase the advance of the ignition beyond the optimum value and will automatically stabilize the idling speed.

The steep edge control or command pulses are produced by a circuit 10 (FIG. 1), known per se, consisting of a shaping and power circuit. It is set for triggering a pulse upon each passage of the voltage of the signal that it receives through a predetermined value which is, as just mentioned, in the neighbourhood of zero.

As will be seen hereinafter, this shaping and power circuit may receive other signals for cancelling out or switching certain of the pulses it triggers.

A main application of the system according to the invention is therefore to control parts of internal combustion engines and in particular the ignition of explosion engines. The angular precision of the ignition is of the order of a degree and requires for the components employed merely a precision which is compatible with their mass-production. Moreover, the value of the required phase advance namely, from 10 to 15 degrees, corresponds to the simple circuits just described.

Figure 9:
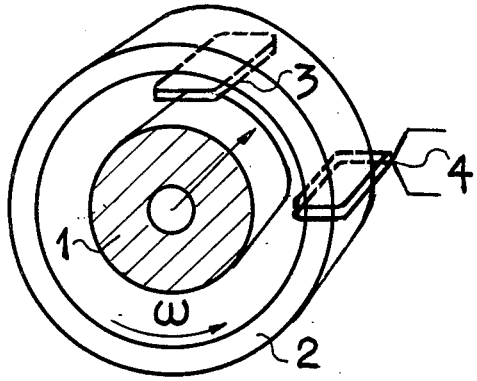
FIG. 9 is a simplified perspective view of the application of the position sensor to an internal combustion engine with a highly effective inductive loop.

FIG. 9 shows the embodiment of an ignition control device. A moving part in the form of a disc 1 which is magnetized in the direction of the arrow is secured either directly to the crankshaft or driven by a device which rotates it at the same speed or at a speed which is a multiple or submultiple of the crankshaft speed. The flux return stator part 2 is in the form of a torus or ring. The magnetosensitive element is fixed at 3, as in the embodiment shown in FIG. 1. The phase shift correction loop 4, constituted either by a flat coil of a few turns or by an integrated turn illustrated in FIG. 5, is placed in such manner as to be in phase quadrature with the element 3. This position requires placing it either adjacent the element 3, between the disc 1 and the ring 2 as shown in FIG. 1, or with an offset of 90 magnetic degrees about said ring 2 as shown in FIG. 9.

Figure 10:
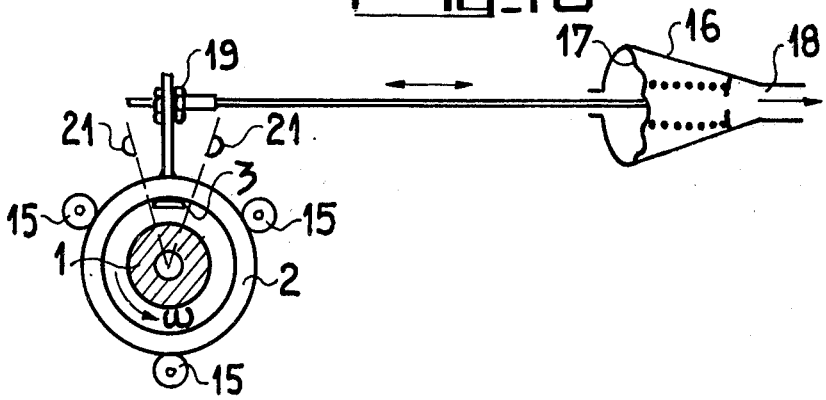
FIG. 10 shows a mechanical device for shifting the phase as a function of the suction in the carburator.

But the ignition of an explosion engine must have an advance which is variable not only with the speed of the engine but also with its torque and power. In practice, there is adopted an advance correction which is a function of the pressure of the gasses in the carburetor downstream of the butterfly throttle. The arrangement shown in FIG. 10 is employed for this purpose. The stator ring 2 is mounted to be rotatable through an angle exceeding the maximum of the phase shift correction as a function of the variation of pressure of the carburetor. The ring 2 has been shown diagrammatically to be rotatable on three rollers 15, but another suspension system may be employed which allows the rotation of the ring. The ring 2 is rotated by the action of a suction sensor 16, known per se, constituted by a diaphragm 17 coupled to a spring and moving under the effect of the pressure prevailing in the carburetor with which it communicates by way of the pipe 18. This diaphragm is mechanically connected to the ring 2 through a regulating device 19. The angular displacements of the ring 2 are limited by a limiting device 21. It can be seen that any variation in the pressure in the carburetor causes the rotation of the ring 2 and the corresponding advance phase shift.

Figure 11:
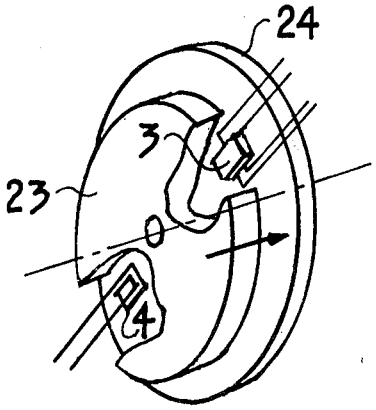
FIG. 11 shows an embodiment of the system with a stator in the form of a disc.
Figure 12:
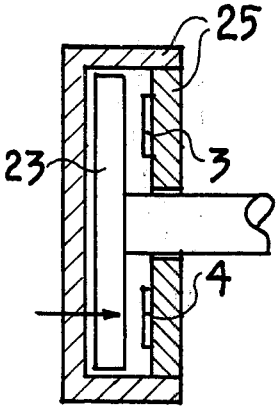
FIG. 12 shows another embodiment of the preceding arrangement with a stator in the form of a box.

FIGS. 11 and 12 show another embodiment of the application of the system according to the invention to an engine. In the foregoing embodiments, the stator part 2 was in the form of a torus outside the system and the airgap field was radial. Here, the moving magnetized part, designated by the reference numeral 1 in FIGS. 1 and 9, is in the form of a disc 23 which is longitudinally magnetized in the direction of the arrow, and the stator part, of soft magnetic material, is also in the form of a disc 24 which is parallel to the preceding disc but fixed. The disc may be formed by a magnet in one piece the magnetization of which varies from one point to the other, or by an appropriate assembly of magnets and soft magnetic materials. The magnetization is such that the longitudinal field induced on the stator part has a substantially sinusoidal circular distribution. The magnetic field is here in the airgap substantially parallel to the axis.

The magnetosensitive element 3 and the correcting coil 4 are fixed in the airgap in a radial plane between the two discs 23 and 24, the disc 23 having been broken away in FIG. 11 to show the position of these two elements 3 and 4. In the arrangement shown in FIG. 11, the loop 4 is disposed at 180 degrees from the element 3. For the reasons given hereinbefore, its influence on the phase correction is inverted for the same direction of the turns.

FIG. 12 shows in longitudinal section an arrangement similar to that of FIG. 11 but in which the stator part, designated by the reference numeral 24 is FIG. 11, is here closed (reference 25, FIG. 12) in the form of a box so as to ensure the return of the magnetic flux.

Several examples of applications of the system according to the invention to four-stroke engines having two and four cylinders will now be described.

Figure 13:
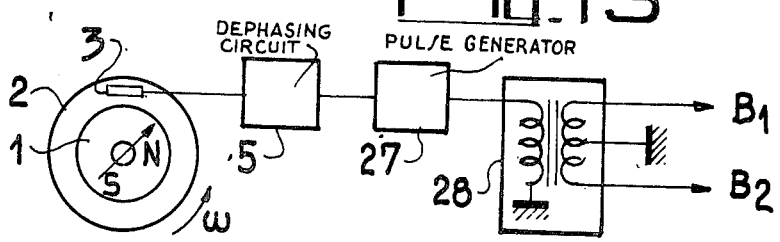
FIG. 13 shows the diagram of the system for an engine having two cylinders.

FIG. 13 shows an ignition system for a two-cylinder engine. The moving part 1 has a simple bipolar magnetization and is driven at the speed $\omega$ of the crankshaft. The magnetosensitive element 3 sends the sinusoidal voltage to a phase-shifting circuit 5. The signal thus shifted in phase is sent to a shaping and amplifying module 27. This power circuit 27 differs from the preceding power circuit 10 that it only delivers a pulse for every other passage through zero, either for the passage from negative to positive or for the passage from positive to negative. These pulses are sent to an ignition coil having two outputs each connected to a cylinder B1 or B2.

Figure 14:
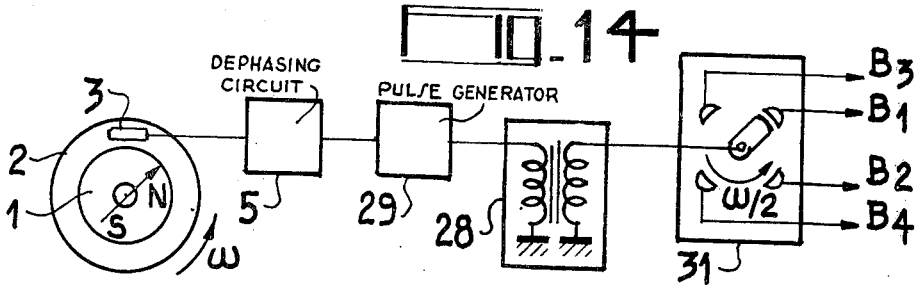
FIG. 14 shows the diagram of the system for an engine having four cylinders.

FIG. 14 shows an application to an engine having four cylinders. The disc 1 has a simple (bipolar) magnetization and it is drive, at the speed $\omega$ of the engine. After having been processed in a phase shifting circuit 5 identical to the preceding circuit, it is sent to a shaping and power circuit 20 which differs from the similar circuit 27 of FIG. 13 in that it sends a steep edge pulse upon each passage through zero of the signal (and not every other passage). These pulses are sent to a conventional distributor 31 which rotates at the semi-speed $\omega/2$ and is connected to the four sparking plugs B1, B2, B3 and B4 in the conventional order. This arrangement, which constitutes a simplification over the present mechanical device, has however two drawbacks; the first is that it requires, as mentioned hereinbefore, a magnetosensitive element which is particularly well balanced and devoid of a residual voltage since the two passages through zero (from − to + and from + to −) are employed and, secondly, it requires the driving of a distributor at the semi-speed $\omega/2$ (as in present engines) with the corresponding complication of gears.

In order to overcome the first of these drawbacks related to the utilization of all the passages through zero, the disc 1 is given a tetrapolar magnetization. This may be achieved in the known manner by an assembly of magnets and evolutive soft magnetic poles, or according to one of the two following manners illustrated in FIGS. 15*a* and 15*b*.

Figure 15:
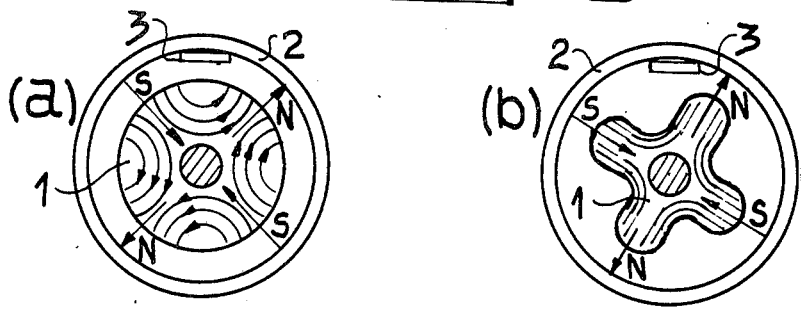
FIGS. 15 and 16 show a tetrapolar magnetized part.

FIG. 15*a* shows in section a round magnet magnetized in a multipolar manner (four). The latter is demagnetized in a nonuniform manner so that it sends an induction field having a substantially sinusoidal space distribution in the airgap.

FIG. 15*b* shows a magnet having evolutive projecting poles so designed that it also sends an induction field having a sinusoidal distribution in the airgap in the region of the sensitive element 3.

Figure 16:
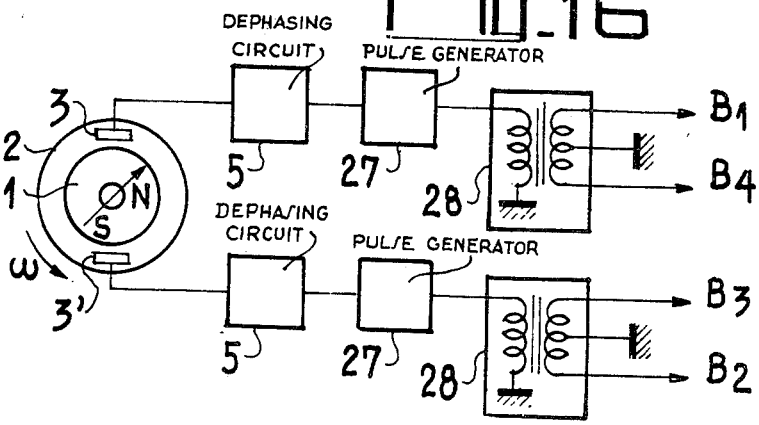

FIG. 16 shows an ignition system for an engine having four cylinders. This system is simply double that of the system described hereinbefore with reference to FIG. 13 for an engine having two cylinders. Two sensitive elements 3 and 3' are placed on the stator part and each feed current to two ignition coils 28 having two outputs through the same circuits as those shown in FIG. 13 with the same reference numerals. The elements 3 and 3' are shown to be offset 180 degrees: in fact they may be placed on the same generatrix of the stator ring 2, but in order that they supply current to the ignition coil at 180 electric degrees apart, the polarity of one element 3 or 3' is changed, either by modifying a shaping circuit 27 so that it utilizes a passage through zero from − to + or from + to −.

As the two passages through zero are employed, it is necessary, in order to compensate for the phase shift due to a residual voltage (see above), to adjust the residual voltage of the generator 3' to that of the generator 3 by means of an outside resistance according to the known method, or to adjust, geometrically, the position of one element with respect to the other.

Figure 17:
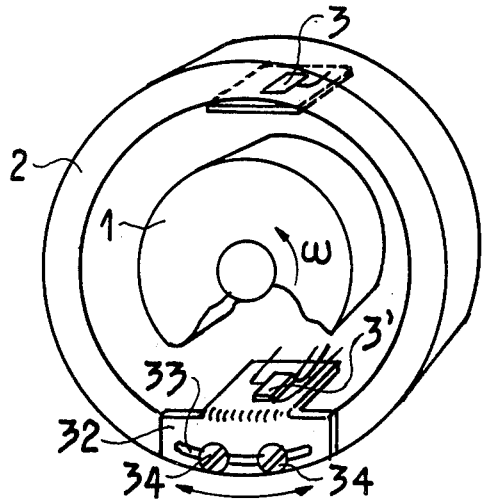
FIG. 17 shows an element position correcting device.

FIG. 17 shows a device capable of achieving this mechanical regulation. The magnetosensitive element 3' is fixed to a support 32 which is fixed to the stator ring 2 by means of oval apertures 33 through which clamping screws 34 extend. When setting the ignition of the engine, the element 3' is displaced in such manner that the effective zeros of each one thereof are adjusted with respect to each other.

Figure 18:
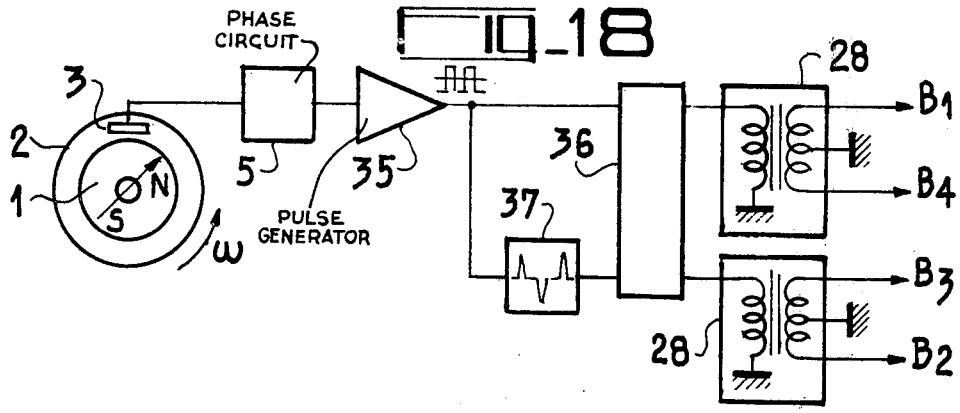
FIG. 18 shows another system for an engine having four cylinders.

FIG. 18 shows another ignition system for an engine having four cylinders. The moving part is magnetized in a bipolar manner and driven at the speed $\omega$ of the engine.

The signals produced are, after passage through the advance correcting circuit 5, sent to a shaping amplifier 35 which sends its pulses, on the one hand, to a power module 36 and, on the other hand, to a branch circuit 37 which furnishes the voltage spikes the sign of which indicates the direction of the passage through zero of the pulses issuing from the shaping circuit 35. The power module 36 receives both the pulses from 35 and the spikes from 37 and supplies corrent to the primary windings of two ignition coils 28, alternately one or the other, in accordance with the sign of the spikes from the branch circuit 37.

This system is particularly simple since it employs a magnetized part which rotates at the speed of the engine and it requires a single circuit and no distributor. But, as has been mentioned hereinbefore, it employs the two passages through zero of the signal, which requires a careful compensation for the residual voltage of the magnetosensitive element.

Figure 19:
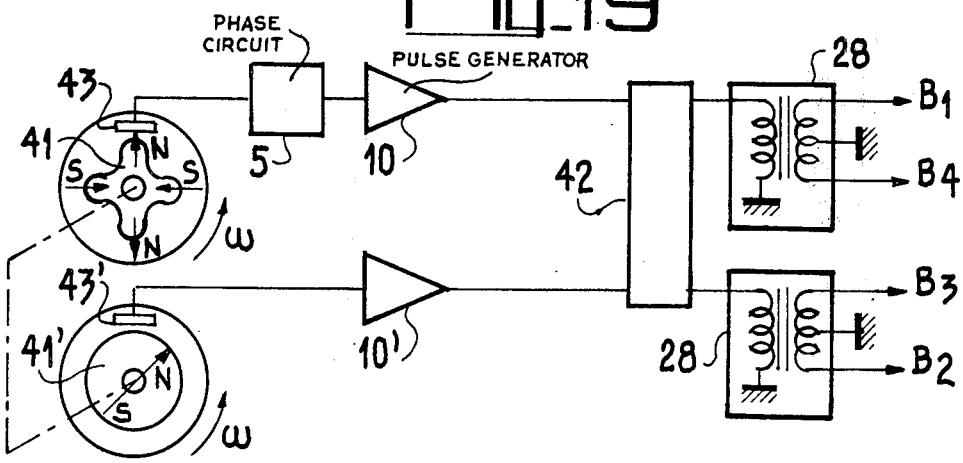
FIG. 19 shows another system for an engine having four cylinders.

FIG. 19 shows another system for an engine having four cylinders employing a magnetized moving part driven at the speed of the engine and comprising two magnetized members. A first member 41, magnetized in a tetrapolar manner, and a second member 41' magnetized in a bipolar manner. Each of these two members is provided with a magnetosensitive element respectively 43 and 43'. The member 41 sends its signals to a power module 42 through a correcting circuit 5 and shaping circuit 10 similar to those described hereinbefore. The signals produced by the member 41' are sent to the module 42 through a shaping circuit 10' without undergoing an advance correction. The power module 42 supplies current to the primary windings of the two ignition coils 28 and interrupts the supply alternatively in accordance with the sign of the signal from the elements 43'. (Sense finders) which is exposed to the variations in the magnetic field of the bipolar member 41'. The power module 42 receives a pulse upon each passage through zero in a given direction of the signal from the element 43 which is exposed to the variations in the magnetic field of the quadripolar member 41. The element 43 therefore furnishes the pulses which will be employed for the ignition, whereas the sense finding element 41' furnishes the pulses which determine which one of the ignition coils 28 will receive the pulse from the module 42.

This system therefore employs a moving comprising two members driven at the speed of the engine, and the passages through zero of the signal in a single direction—which requires no precise compensation for its residual voltage and moreover there is no distributor. It is therefore simple in construction and reliable.

Figure 22:
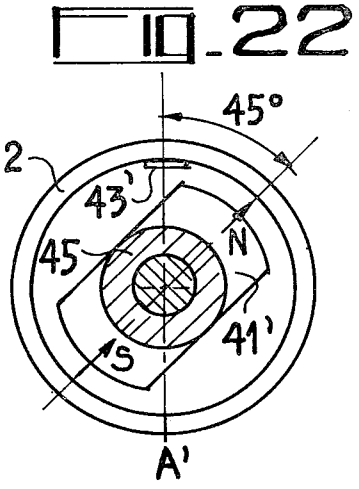
FIGS. 20, 21 and 22 show an embodiment of a double position sensor which is both tetrapolar and bipolar.
Figure 21:
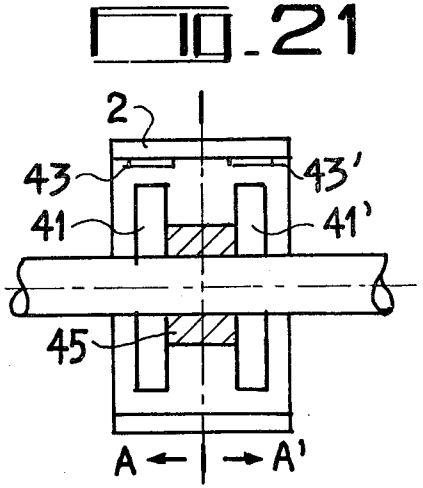
Figure 20:
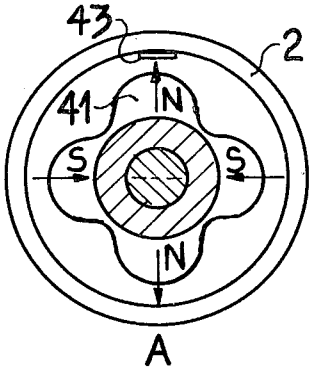

The moving part comprising two members (one having four poles and the other two) is constituted as shown in FIG. 20, 21 and 22. FIG. 21 shows an axial sectional view of said part and FIGS. 20 and 22 show a radial sectional view in the directions A and A' respectively. The magnet 41 has, in accordance with the well-known technique, a form adapted to its magnetism so as to create a substantially sinusoidal variation of the field on element 43. This tetrapolar magnet 41 is connected to a bipolar magnet 41' by a spacer member 45. In contradistinction to the magnet 41, this bipolar magnet has no need to have a form adapted to create a sinusoidal variation in the magnetic field on the element 43', it is sufficient that it be positive or negative in an angular position approximately corresponding to the passage through zero of the tetrapolar field. For this reason the residual voltage of this element 43' has no need to be compensated for.

Figure 25:
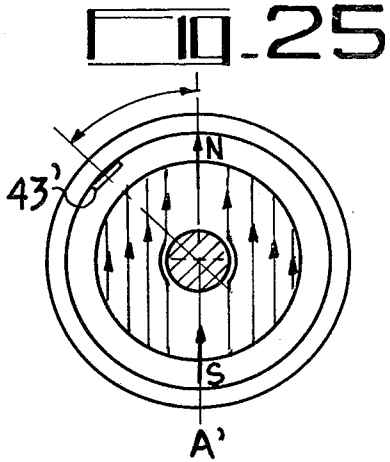
FIGS. 23, 24 and 25 show another embodiment of a double position sensor which is both tetrapolar and bipolar.
Figure 24:
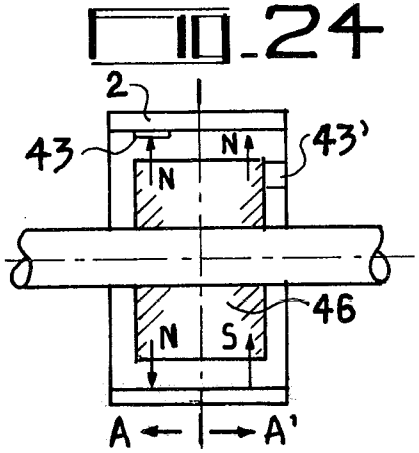
Figure 23:
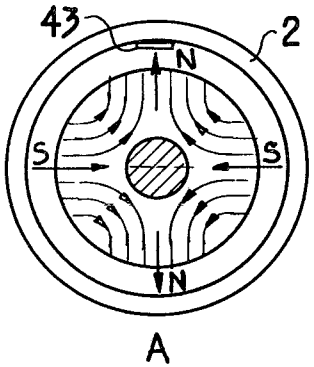

Another embodiment of the magnetized moving part comprising two members is illustrated in FIGS. 23, 24 and 25 in which FIG. 24 represents an axial sectional view of the moving part and FIGS. 23 and 25 a radial sectional view in the directions A and A' respectively. The magnetized part 46 comprising two members is here in one piece and constituted by a single isotropic magnet; the latter is thereafter demagnetized in a different manner to form a magnetized position having four poles as indicated in FIG. 23, and another dipolar magnetized portion indicated in FIG. 25. As in the preceding embodiment, the demagnetization of the tetrapolar portion must be effected in such manner that the magnetice field induced in the region of the magnetosensitive element 43 be substantially sinusoidal in the course of the rotation of the part 46. The demagnetization of the bipolar portion may be effected in a less precise manner so as to present to the sensitive element 43' (sense finder) a NORTH or SOUTH pole in the course of a passage through zero of the magnetic field in front of the element 43.

There has thus been described an application of the system to the ignition of a explosion engine having two and four cylinders, but it will be understood that it is equally applicable to engines having any number of cylinders, the number of poles of the magnetized moving part and the number of magnetosensitive elements being adapted to the number and position of the cylinders. In the case of multiple systems, it will be the number of ignition coils and the number of power circuits, or the number of sense finders, which will be adapted to the chosen solution.

Likewise, the system may be applied to the control of devices other than the ignition, as, for example, the injection in Diesel engines and the advance of the commutation of dc electric motors having an electronic commutation.

Of course the invention is not limited to the embodiment described and shown which was given solely by way of example.

What is claimed is:

1. A system in an internal combustion engine for producing an electric signal in synchronism with the periodic movement of an engine part, said signal being subjected to a variable phase shift and controlling a cyclic operation of said engine, comprising:

a permanently magnetized, moving rotor part rotated with said part and oriented in a radial plane;

a soft magnetic alloy stator part in the vicinity of the rotor part;

a magnetosensitive element fixed to the stator part and located between said stator part and said rotor part, said element being of the type having an output signal whose amplitude is independent of the speed of phase shift variation, the form of said rotor part and its movement producing a substantially sinusoidal variation of the magnetic field so that said element delivers a substantially sinusoidal electric signal whose frequency is proportional to the frequency of rotation;

a phase correcting circuit for processing said signal to produce a phase corrected signal, said phase correcting circuit comprising an induction loop subjected to the variations of the magnetic field, said loop being associated with the magneto-sensitive element and producing a phase shift of the signal which varies with the speed of movement; and a shaping circuit for delivering from said phase corrected signal a pulse in response to the passage of said corrected signal through a given amplitude.

2. A system as claimed in claim 1, wherein the magnetosensitive element comprises magnetoresistors.

3. A system as claimed in claim 1, wherein the magnetosensitive element is a Hall generator.

4. A system as claimed in claim 1, wherein the induction loop is constituted by the trace of the connection conductor of the magnetosensitive element, said conductor being deposited on the substrate which supports the sensitive element.

5. A system in an internal combustion engine for producing an electric signal in synchronism with the periodic movement of an engine part, said signal being subjected to a variable phase shift and controlling a cyclic operation of said engine, comprising:

a permanently magnetized, moving rotor part rotated with said part and oriented in a radial plane;

a soft magnetic alloy stator part in the vicinity of the rotor part;

a magnetosensitive element fixed to the stator part and located between said stator part and said rotor part, said element being of the type having an output signal whose amplitude is independent of the speed of phase shift variation, the form of said rotor part, and its movement producing a substantially sinusoidal variation of the magnetic field so that said element delivers a substantially sinusoidal electric signal whose frequency is proportional to the frequency of rotation;

a phase correcting circuit comprising a combination of resistors and capacitors for processing said signal to produce a phase corrected signal; and a shaping circuit for delivering from said phase corrected signal a pulse in response to the passage of said corrected signal through a given amplitude.

6. A system as in claim 1, wherein the induction loop subjected to the variation of the field is disposed substantially in a plane parallel to the magnetosensitive element.

7. A system as in claim 1, wherein the moving part is in the form of a disc magnetized radially and the stator part is in the form of a ring.

8. A system as in claim 7, wherein the induction loop subjected to the variation of the field is located around the ring in a plane passing through the axis of rotation of the magnetized disc, said loop being offset by a magnetic angular offset of 90 degrees with respect to the sensitive element.

9. A system as in claim 1, wherein the moving part is in the form of a radial disc magnetized in the axial direction and the stator part is in the form of a hollow cylinder coaxially surrounding said moving part.

10. A system as in claim 5 wherein the stator part is mounted to be movable in rotation through an angle greater than the maximum phase shift to be applied to the signal and the phase shift correction to be applied to the signal is obtained by rotation of said stator part.

11. A system as in claim 6, wherein said engine is an explosion engine having two cylinders the ignition of which engine is controlled by said system, wherein the moving part is driven at the speed of the engine and has a single pair of poles, said shaping circuit comprising a shaping and amplifying circuit which delivers a signal upon each pasage through zero of the signal in a given direction, said signal being applied to the primary winding of an ignition coil which has two outputs each connected to a cylinder.

12. A system as in claim 6 wherein said engine is an explosion engine having four cylinders the ignition of which engine is controlled by said system, and wherein the moving part is driven at the speed of the engine and has a single pair of poles, the stator part has two magnetosensitive elements offset from each other by 180 magnetic degrees, each one of the two outputs of the two coils being connected to a cylinder.

13. A system as claimed in claim 12, wherein one of the two sensitive elements is mounted on the stator part by means of a support which is capable of being angularly offset.

14. A system as claimed in claim 6 wherein said engine is an explosion engine having four cylinders the ignition of which engine is controlled by said system and wherein the moving part is driven at the speed of rotation of the engine and has a single pair of poles, the stator part comprises a single magnetosensitive element, the signal produced by the sensitive element is shifted in phase by a phase correcting circuit, the signal thus shifted in phase is shaped by a shaping circuit which received in each direction, the output of said shaping circuit is connected to a power module and to a branch circuit furnishing voltage spikes the sign of which spikes indicates the direction of the passage through zero of said signal received by said shaping circuit, the output of said branch circuit being connected also to the power module, which module has two outputs each connected to the primary winding of two ignition coils which have two outputs each connected to a cylinder, the power module coupling the current supply of the two ignition coils alternately in accordance with the sign of the voltage spikes delivered by the branch circuit, in response to the direction of the passage through zero of the signal received by the shaping circuit.

15. A system in an internal combustion engine for producing an electric signal in synchronism with the periodic movement of a shaft connected to the crankshaft, said signal being subjected to a variable phase shift and controlling an ignition coil which has two outputs each connected to a cylinder, comprising:

a permanently magnetized, moving rotor part mounted on said shaft and having a first and a second member which are axially offset;

a soft magnetic alloy stator part in the vicinity of the rotor part;

magnetosensitive means fixed to the stator part and located between said stator part and said rotor part, said means being of the type having an output signal whose amplitude is independent of the speed of phase shift variation, the form of said rotor part and its movement producing a substantially sinuosidal variation of the magnetic field so that said element delivers a substantially sinusoidal electric signal whose frequency is proportional to the frequency of rotation;

the first member having a radially oriented tetrapolar magnetization and the second member having a bipolar magnetization, the North and South poles of the bipolar magnetization being angularly offset with respect to their associated element substantially on a neutral line of the tetrapolar magnetization, said means comprising a first magnetosensitive element fixed to the stator part and located between said stator part and the first member of the moving part having a tetrapolar magnetization, and a second magnetosensitive element, termed a sense finder, fixed to the stator part and located between said stator part and the second member of the moving part having a bipolar magnetization;

a phase correcting circuit for processing said signal to produce a phase corrected signal; and a shaping circuit for delivering from said phase corrected signal a pulse in response to the passage of said corrected signal through a given amplitude, the output of said shaping circuit being applied to one of two inputs of a power module, whereas the signal produced by the sense finder is applied, after shaping, to the second input of said power module which module has two outputs each connected to the input of an ignition coil which has two outputs each connected to a cylinder, the signal produced by the sense finder is a positive or negative as a function of the polarity of the magnetization of the second member of the moving part in front of which second member said sense finder is located, the signals produced by said power module are applied alternately to either one of its outputs depending on whether the signal produced by the sense finder is positive or negative.

16. A system as claimed in claim 15, wherein the two members of the moving part connected to the crankshaft are constituted by magnets formed respectively to be tetrapolar and bipolar and interconnected by a spacer member.

17. A system as claimed in claim 15, wherein the moving part connected to the crankshaft is constituted by a single isotropic magnet which is magnetized and regulated by demagnetization in the tetrapolar form on one side of the magnet and bipolar form on the other side of the magnet.

* * * * *